United States Patent [19]

Carter et al.

[11] Patent Number: 4,487,030

[45] Date of Patent: Dec. 11, 1984

[54] GAS/ELECTRIC OPERATED ABSORPTION REFRIGERATOR HAVING AUTOMATIC FLAME DETECTION AND RESTART CAPABILITY WITH VISUAL INDICATION OF OPERATING STATUS

[75] Inventors: Randy E. Carter, Waynesfield; Ernst R. Schmidt, Sidney, both of Ohio

[73] Assignee: The Stolle Corporation, Sidney, Ohio

[21] Appl. No.: 521,189

[22] Filed: Aug. 8, 1983

[51] Int. Cl.[3] ..... F25B 15/00

[52] U.S. Cl. ..... 62/141; 62/148; 431/80

[58] Field of Search ..... 62/125, 126, 141, 148; 431/78, 80

[56] References Cited

U.S. PATENT DOCUMENTS

| | | | |
|---|---|---|---|
| 3,370,436 | 2/1968 | Romanelli | 62/148 |
| 3,847,533 | 11/1974 | Riordan | 431/78 |
| 3,853,455 | 12/1974 | Riordan et al. | 431/80 |
| 3,861,854 | 1/1975 | Walbridge | 431/80 |
| 4,147,494 | 4/1979 | Ando et al. | 62/148 X |
| 4,188,182 | 2/1980 | Junak | 431/80 |
| 4,236,380 | 12/1980 | Blomberg et al. | 62/148 |
| 4,242,879 | 1/1981 | Blomberg | 62/148 |

OTHER PUBLICATIONS

Installation Instruction for Fenwal Series 05-15 12 Volt DC Direct Spark Ignition System, dated 6/81.

*Primary Examiner*—Lloyd L. King

*Attorney, Agent, or Firm*—Frost & Jacobs

[57] ABSTRACT

An absorption refrigerator having a generator selectively heated by an electrically operated resistance heater or a flammable gas operated burner. In the gas mode of operation, a monitor electrode positioned above the gas burner automatically senses the absence of the burner flame and commences a restart sequence to reignite the burner. If reignition fails or the burner cannot be ignited within a predetermined time, further ignition attempts are inhibited and an indicator lamp on the front of the refrigerator enclosure above the freezer door provides a visual indication that cooling is not being supplied to the refrigerator. Different colored visual indicators are also provided to show that the refrigerator is being operated by gas or electricity. In another embodiment, the refrigerator may be selectively operated from alternating current, direct current or flammable gas, with colored indicator lamps showing the type of power source used.

14 Claims, 7 Drawing Figures

GAS/ELECTRIC OPERATED ABSORPTION REFRIGERATOR HAVING AUTOMATIC FLAME DETECTION AND RESTART CAPABILITY WITH VISUAL INDICATION OF OPERATING STATUS

SUMMARY OF THE INVENTION

The present invention is directed to an absorption type refrigerator which uses a burner employing propane, LP or other flammable gas to create the heat needed for the absorption cycle generator. The principles involved with such absorption refrigeration cycles are well-known, and have found widespread use in refrigeration apparatus, particularly refrigerators used in recreational vehicles and the like.

One of the most common problems associated with such refrigeration apparatus is monitoring the presence of the gas flame when the temperature within the refrigerator has risen to the point that the thermostat is calling for cooling. In conventional practice, the gas flame is observable through a transparent plastic rod positioned on the front or side of the refrigerator. Usually, the gas burner, and consequently the plastic gas flame observation rod, are positioned at the lower section of the refrigerator which requires the user to stoop or kneel to look at the flame. In addition, if the ambient lighting conditions are relatively bright, the gas flame may not be visible at all through the observation rod. Consequently, it may be impossible to determine whether the flame has been established initially or if the flame has been lost during operation, possibly due to exhaustion of the gas supply. In many instances, loss of flame isn't noticed until the refrigerator door is opened.

The refrigeration apparatus of the present invention eliminates the need to visually observe the gas flame by automatically detecting the presence or absence of the flame and automatically reigniting the gas burner, if necessary. Furthermore, the refrigeration apparatus can be powered from any one of a variety of energy sources such as gas, direct current or alternating current. The selection of the type of energy supply is completely under control of the operator. Furthermore, visual read-outs provide a readily discernible indication of the type of energy source being used, and in the case where heat is being supplied to the generator by gas, a clear visual indication of the presence or absence of the gas flame.

A first embodiment of the present invention comprises the usual type of box-like absorption refrigerator mechanical cooling system incorporating a heat operated generator. A thermostat monitors the internal temperature of the refrigerator enclosure. A gas burner or an electrically operated heater supplies heat to the generator. An electrically operated solenoid valve controls the supply of propane, butane, LP or other flammable gas to the burner, while a high voltage electrical spark is utilized to establish a flame at the burner.

Electrical control means control the operation of the burner and heater and include switches to manually select the burner or the heater so that the refrigerator is operated by gas or electricity. A probe-like sensing electrode monitors the flame produced by the burner when the switch selects the gas mode of operation.

Starting means operate the solenoid and the spark means for a short period of time to establish the flame at the burner if the thermostat is calling for cooling. In the event that the flame is extinguished during operation of the refrigerator, restart means also responsive to the monitoring means re-establish the flame by activating the spark means when the thermostat is calling for cooling.

Finally, the control system of the present invention also includes lock-out means to prevent further operation of the solenoid and spark means if a flame is not established within a first predetermined time period following initial activiation of the solenoid and spark means by the starting means or if the flame is interrupted and not re-established within a second predetermined time following activation of the spark means by the restarting means.

A number of indicator lamps on the front panel of the refrigerator provide a visual indication whether the refrigerator is in the gas or electric mode. In a second embodiment of the invention where the refrigerator may be operated from 12 VDC, 110 VAC or gas, the indicator lamps show which of the two electrical sources is being used. Another indicator lamp indicates that the lock-out means has been activated as a result of failure to establish a flame within either of the predetermined time periods described hereinabove when the refrigerator is operated in the gas mode. The visual indicator of the present invention are located above the refrigerator freezer door compartment so as to be easily visible, even from a distance, without kneeling or bending. Consequently, the conventional observation rod described hereinabove can be eliminated.

Further features of the invention will become apparent from the detailed description which follows.

DETAILED DESCRIPTION

Figure 1:
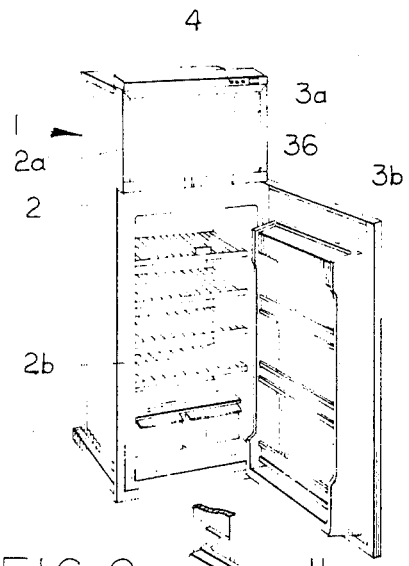
FIG. 1 is a front prospective view of an absorption refrigerator utilizing the automatic flame detection and restart features of the present invention.

A refrigerator using the refrigeration apparatus of the present invention is illustrated generally at 1 in FIG. 1. Refrigerator 1 includes a box-like enclosure 2 defining an upper freezer compartment **2*a* and a lower cold food compartment 2*b*. The freezer compartment 2*a* is closed by means of a front opening vertically hinged door 3*a*, while the lower compartment 2*b* is closed by a similarly hinged but larger door 3*b*. Refrigerator 1** has special utility for use in a recreational vehicle or the like.

The upper portion of refrigerator 1 is provided with a visually perceptible display 4 for monitoring the mode and status of the refrigerator as will be described in more detail hereinafter. It will be noted that the display 4 is mounted above the refrigerator doors, and particularly above the freezer compartment door so that the user does not have to stoop or bend over to see the operating status of the refrigerator.

Figure 2:
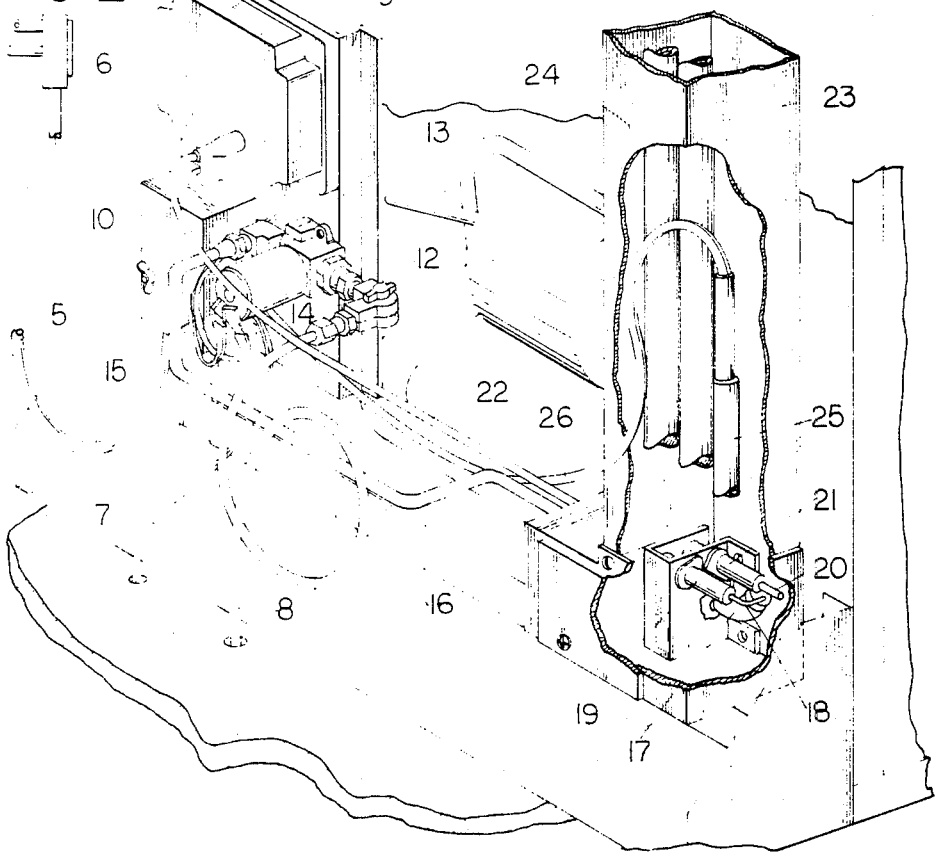
FIG. 2 is an enlarged fragmentary rear perspective view of the lower rear portion of the refrigerator of FIG. 1 illustrating the absorption refrigeration apparatus.

The details of the absorption refrigeration system associated with the refrigeration apparatus of the present invention is illustrated in more detail in FIG. 2. It will be understood that this portion of the refrigeration apparatus may be located in the lower rear part of refrigerator 1 illustrated in FIG. 1.

Alternating current from a conventional source of 110 VAC electrical service is supplied to the refrigerator by means of a line cord 5 and an associated electrical plug 6. As will be explained in more detail hereinafter, the refrigerator 1 may be alternately powered from a battery source utilizing 12 VDC through electrical supply line 7. Furthermore, refrigerator 1 may be operated from a source of flammable gas such as propane, butane, LP gas or the like which is supplied through gas supply conduit 8.

The electrical and electronic components of the control system of the present invention are mounted on a vertically extending mounting plate 9 which is fixedly attached to the refrigerator base. Mounting plate 9 includes a first control module 10, and a second control module 11. As will be explained in more detail hereinafter, first control module controls the operating mode of the refrigerator, while second control module 11 controls the ignition and monitoring of the gas burner when refrigerator 1 is operated from a gas supply.

As illustrated in FIG. 2, gas from a source of supply (not shown) is supplied through supply conduit 8 to a manually operated shut-off valve 12. The outlet port of valve 12 is connected to the inlet port of gas control valve 13, which is actuated by a solenoid 14 responsive to electrical signals on lines 14 from second control module 11. The outlet port of solenoid actuated valve 13 is connected by means of a gas supply conduit 16 to gas burner 17. As will be explained in more detail hereinafter, the flow of gas to gas burner 17 may be controlled by means of solenoid operated valve 13.

Spaced immediately above gas burner 17 is an electrically conducting rod-like ignition electrode 18 supported by a ceramic stand-off 19 for establishing the flame at gas burner 17, and an electrically conducting rod-like sensing electrode 20 also supported by a ceramic stand-off insulator 21 for monitoring the presence or absence of the flame at the burner. It will be observed that electrodes 18 and 20 are arranged in generally parallel relationship such that the end of the electrodes extend into the burner flame. Ignition electrode 18 is connected to second control module 11 by a high voltage cable 22, while sensing electrode 20 is connected to second control module 11 by suitable electrical conductors, not shown.

Burner 17 is enclosed in the lower portion of a chimney-like vertically extending heating chamber 23, which also encloses the pipe-like generator portion 24 of the absorption refrigerating apparatus as is well-known in the art. Burner 17 is so positioned as to raise the temperature of the refrigeration liquor flowing within the tubular generator 24 to create the necessary gaseous mixture as is well-known in the art.

As will be explained in more detail hereinafter, heat may be alternately supplied to generator 24 by means of an electrical resistance heater 25 closely associated with the generator which receives electrical current through electrical conductor 26 under control of the circuitry in first control module 10 as will be explained in more detail hereinafter. Consequently, it will be understood that heat may be supplied to the generator portion of the absorption refrigeration apparatus through burning flammable gas, or by means of an electrically operated resistance heater.

Figure 4:
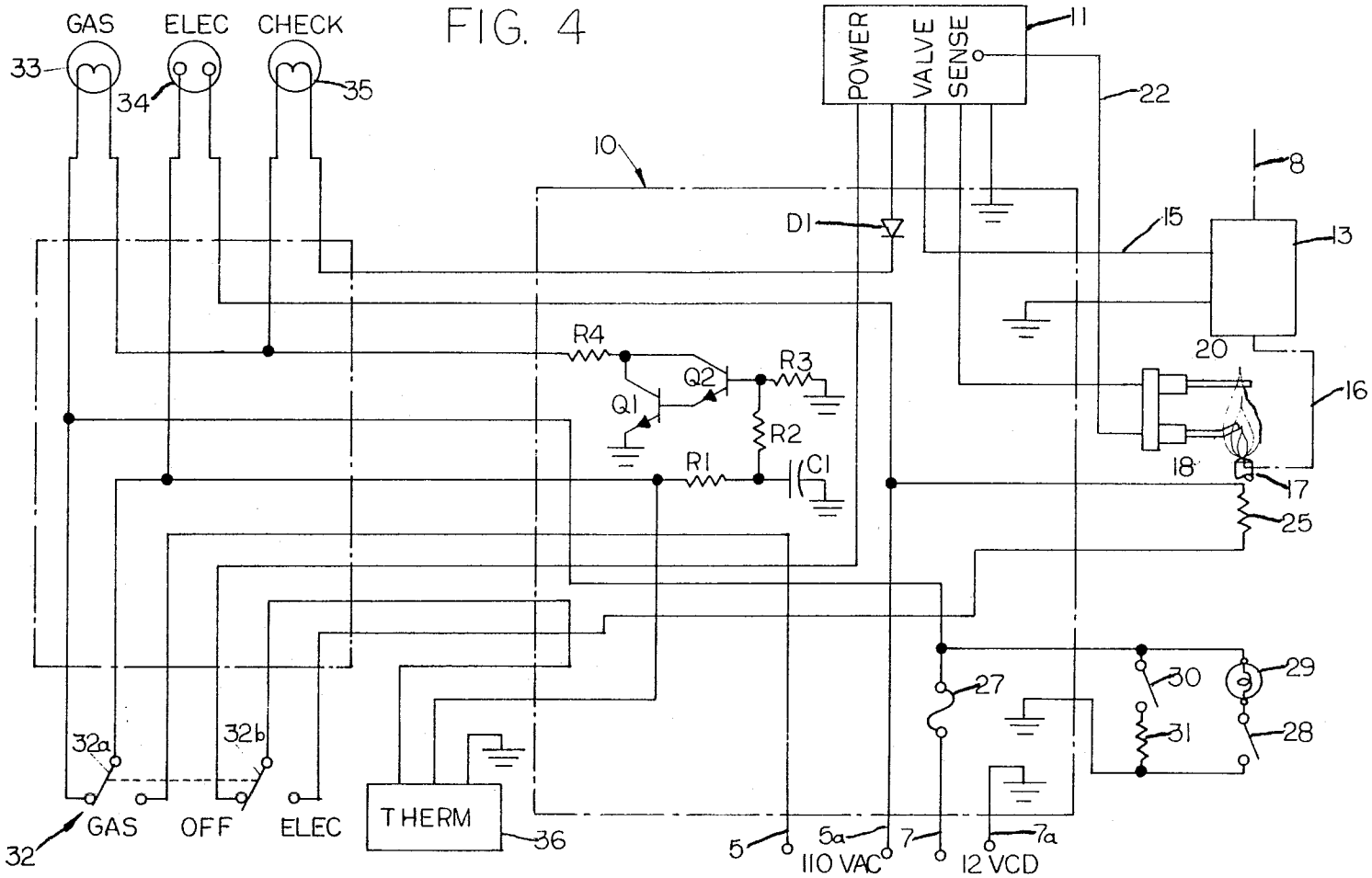
FIG. 4 is a diagrammatic schematic diagram of a first embodiment of the present invention.

The circuitry comprising a first embodiment of first control module 10 and second control module 11 is illustrated schematically in FIG. 4, where elements similar to those previously described have been similarly designated. In this embodiment, the refrigeration apparatus may be selectively operated by 110 VAC or flammable gas.

The alternating current is supplied to first control module 10 from a source of 110 VAC (not shown) on hot supply line 5 and neutral supply line 5*a*. Direct current from a battery or other source of 12 VDC (not shown) is supplied to first control module 10 on supply line 7 and ground 7*a*. An electrical fuse 27 may be inserted in 12 VDC line 7, as desired. Flammable gas is supplied from a source of supply (not shown) through supply conduit 8, solenoid operated valve 13 and supply conduit 16 to gas burner 17 as previously described. A door switch 28 actuates an interior light 29 when the refrigerator door 3 is opened. In addition, a switch 30 may be normally actuated to activate a heater 31 to eliminate condensation within the refrigerator as is well-known in the art.

Figure 1A:
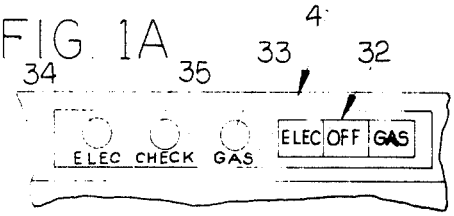
FIG. 1A is an enlarged fragmentary view of the visual display of the absorption refrigerator of the present invention.

The operating mode of the refrigerator is selected by mode switch 32. As illustrated in FIG. 1A and FIG. 4, mode switch 32 comprises a ganged rocker switch having a center-off position, and alternately operable positions to select the gas (GAS) or electric (ELEC) modes of operation. When switch 32 is in the position illustrated in FIG. 4, the GAS mode will be selected. However, when the movable actuators 32*a* and 32*b*. of switch 32 are shifted to the right is illustrated in FIG. 4, the refrigerator may be operated from 110 VAC.

Visual indicators in the form of incandescent or neon lamps are also provided on the upper portion of refrigerator 1 above the freezer compartment as at 4 to provide a visual indication of the mode and status of the refrigerator. Specifically, a first lamp 33, which may be blue, for example, is illuminated if the refrigeration apparatus is being operated from a gas supply. A second lamp 34, which may be green, for example, is illuminated if the refrigeration apparatus is operated from 110 VAC. Finally, a third lamp 35 which may be red, for example, is illuminated if the system is operating in the gas mode, and if the flame associated with burner 17 has failed to ignite. Lamps or indicators 33–35 are arranged side-by-side in a horizontal line generally at eye level for high visibility.

Each of the operating modes of the present refrigeration apparatus will now be described in detail.

When mode selector switch 32 is moved to the ELEC position, 110 VAC from line 5 is applied to the center contact 32*a* and hence to ELEC indicating lamp 34, thermostat switch 36, and resistor R1. It will be observed that the other contact of ELEC lamp 34 is connected to neutral line 5*a*, so that lamp 34 is illuminated, showing that the system is in the ELEC mode of operation.

As illustrated in FIG. 1, thermostat 36 may be located in the upper portion of the refrigerator cavity to monitor the temperature therewithin. If thermostat 36 is calling for cooling, determined by whether or not the bi-metallic switch associated with the thermostat is closed as is well-known in the art, 110 VAC current is applied through the thermostat switch to the center contact 32*b* of switch 32 and thus to AC resistance heater 25. Since the other terminal of heater 25 is connected to neutral conductor 5*a*, heater 25 is energized to supply heat to generator 24 as described hereinabove. If the interior cavity of refrigerator 1 is sufficiently cool so that thermostat switch 36 opens, 110 VAC is removed from heater 25, and the heater is de-energized. It will also be observed that in this mode of operation, the electronic components associated with resistor R1 are inoperative.

When mode selector 32 is shifted to the GAS position, 12 VDC is supplied to GAS lamp 33, and through center pole 32*a* of switch 32 to resistor R1. Current flow through resistors R1, R2 and R3 cause Darlington pair transistors Q1 and Q2 to turn on, thereby bringing the collectors of these transistors and the remaining terminal of GAS lamp 33 to ground. This causes the GAS lamp to become illuminated. At the same time, a ground is applied to one terminal of CHECK lamp 35, which is turned off during normal operation. Resistor R4 is provided in the collector circuit of transistors Q1 and Q2 to limit the inrush current caused by the cold filaments of lamps 33 and 35. In addition, a capacitor C1 is provided from the junction of resistors R1 and R2 to ground to control the turn-on characteristics of the transistors.

Direct current is also supplied from center pole 32*a* to thermostat switch 36. If the refrigerator is calling for cooling, as indicated by thermostat switch 36 being closed, direct current is also supplied through center pole 32*b* to the POWER input of second control module 11, thus energizing this module. As will be explained in more detail hereinafter, this causes solenoid actuated valve 13 to operate, supplying gas to burner 17, and also ignition electrode 18 to produce a high voltage spark for initiating the flame at the burner. If the flame has not been established within a predetermined time (e.g. 10 seconds) as monitored by sensing electrode 20, a signal is sent on line 22 to second control module 11 to close the solenoid valve and terminate the ignition sequence. At the same time, a signal is produced by second control module 11 to illuminate CHECK lamp 35 to provide a visual indication that ignition of the gas burner has failed.

Figure 3:
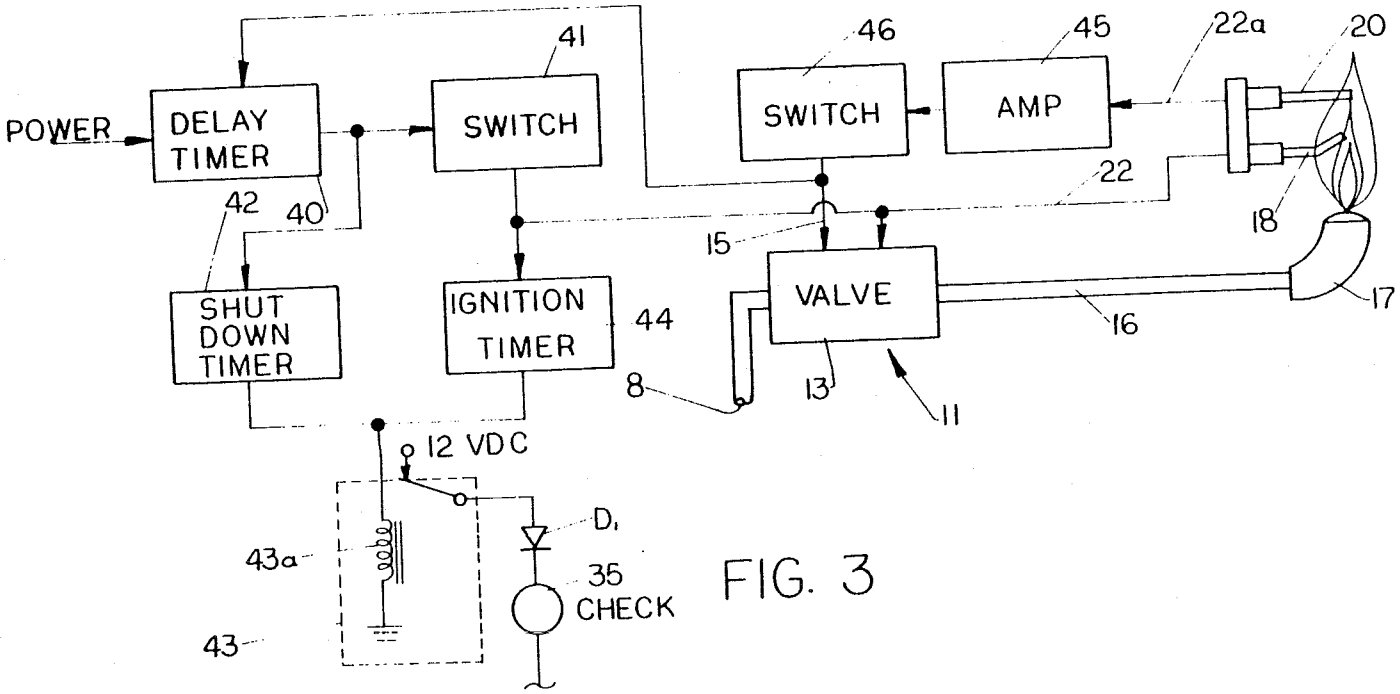
FIG. 3 is a diagrammatic block diagram of the electrical control associated with the refrigeration apparatus of the present invention.

The operation of second control module 11 is illustrated in more detail in FIG. 3. Second control module 11 may be implemented as a Fenwal Series 05-15 12 Volt DC Direct Spark Ignition System manufactured by Fenwal Incorporated, Division of Kidde, Inc. The circuitry of second control module 11 may also be implemented by reference to U.S. Pat. Nos. 3,847,533, 3,853,455 and 3,861,854, the disclosures of which is incorporated herein by reference.

With specific reference to the exemplary implementation illustrated in FIG. 3, when 12 VDC is applied to the POWER input of second control module 11 as previously described, a delay timer 40 begins to time-out in a predetermined time delay. Delay timer 40 enables an electronic switch 41 which opens solenoid operated valve to enable gas to pass to burner 17, and also energizes ignition electrode 18 to produce a high voltage spark for establishing the flame at the burner.

Delay timer 40 also activates a shut-down timer 42 which begins timing out in a preselected shut-down time. If the shut-down timer 42 times-out, a signal is delivered to a lock-out circuit 43 which prevents further operation of solenoid operated valve 13 and ignition electrode 18. At the same time, a signal is delivered through diode D1 to activate CHECK lamp 35 to provide a visual indication that ignition of the gas burner has been unsuccessful. For example, a portion of lock-out circuit 43 may be implemented as a normally closed relay 43*a* which is energized so long as neither shut-down timer 42 nor ignition time has timed-out. If either of these timers times-out, the relay is de-energized, closing the relay contacts and illuminating CHECK lamp 35. It will be understood that combinations of normally opened and normally closed contacts associated with relay 43*a* may also be used to control the operation of lamp 35, valve 13 and ignition electrode 18.

Switch 41 also activates an ignition timer 44 which times-out for a predetermined period of time. If ignition timer 44 times-out, indicating that electrode 18 has been producing a spark for the predetermined period of time, a signal is also delivered to lock-out circuit 43 to prevent further operation of solenoid valve 13 and ignition electrode 18. It will be observed that lock-out circuit 43 is activated when either timer 40 or 44 times-out. Thus these two timers are both "ignition" timers and provide an additional safety feature.

As illustrated in FIG. 3 and FIG. 4, sensing electrode 20 is disposed so as to lie within the burner flame. The presence of the flame produces an electrical current on line 22*a* which may be amplified if necessary by an amplifier 45 as is well known in the art. The output from amplifier 45 enables an electronic switch 46 which also serves to maintain solenoid operated valve 13 in the open position to maintain the flow of gas to burner 17. At the same time, activation of switch 46 operates to reset delay timer 40.

During operation of the circuit just described, under normal circumstances the flame will be established before either shut-down timer 42 or ignition timer 44 has timed-out. In this case, sensing electrode 20 causes switch 46 to maintain the valve in the open position, and continues to reset delay timer 40. Consequently, delay timer 40 is prevented from timing out while switch 46 is activated. Consequently, as long as flame is sensed by sensing electrode 20, shut down timer 42 and switch 41 are inoperable. If flame is lost, switch 46 stops operating and delay timer 40 times-out causing switch 41 to re-establish the ignition sequence through ignition electrode 18. Consequently, the effect of a loss of flame is that the system behaves as it does when initially energized. Thus if flame is re-established, switch 46 is actuated and switch 41 is deactuated, and shut-down timer 40 is reset.

If flame is not established initially, or following an effort to reignite, control module 11 is locked out upon the timing-out of either shut-down timer 42 or ignition timer 44, e.g. after 10 seconds. As noted, a lock-out condition is indicated by illumination of CHECK lamp 35.

Figure 5:
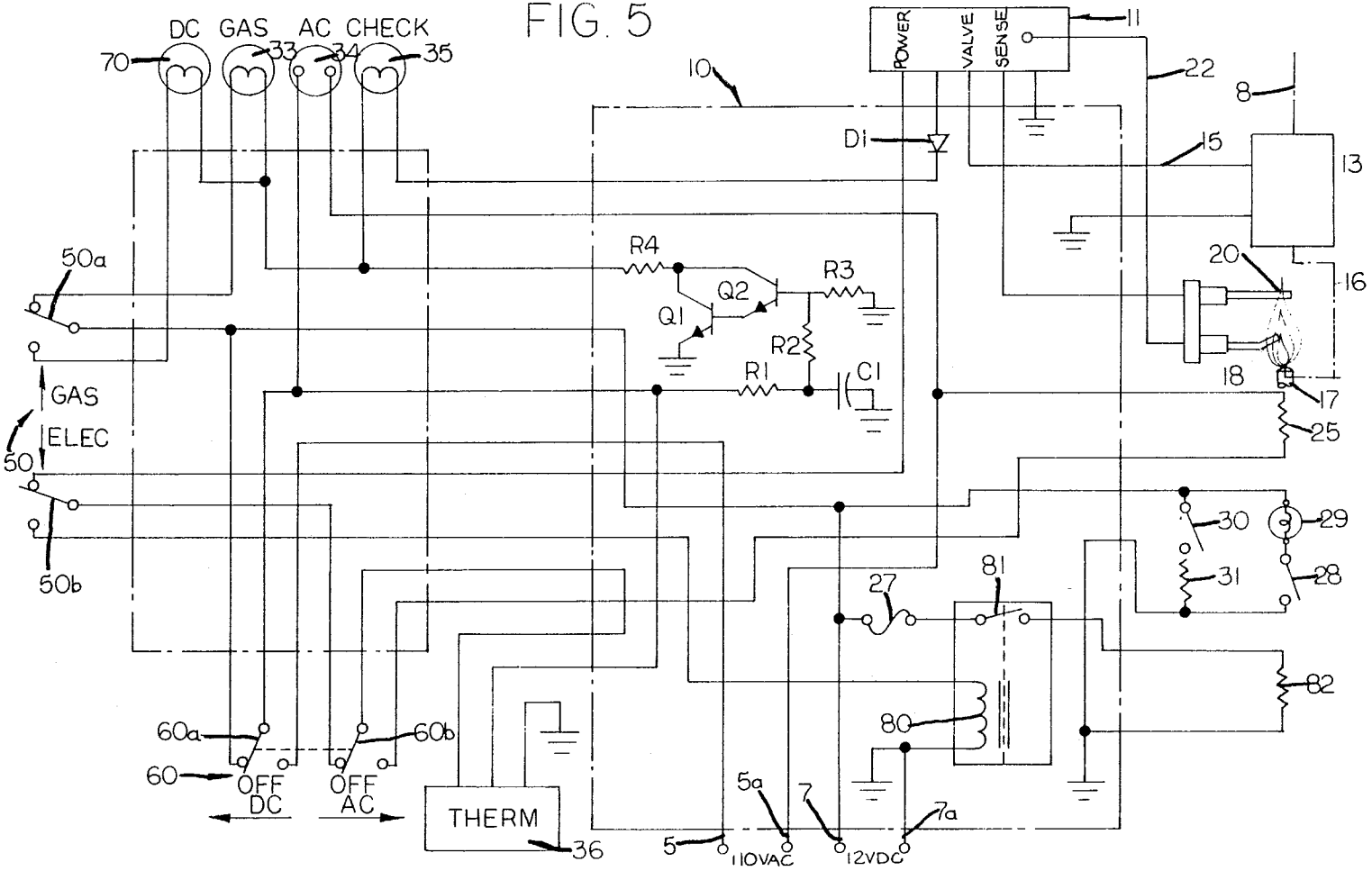
FIG. 5 is a diagrammatic schematic diagram of a second embodiment of the present invention.

Another embodiment of the present invention is illustrated in FIG. 1D and FIG. 5, where elements similar to those previously described are similarly designated. This embodiment enables the refrigeration apparatus to operate from 110 VAC, 12 VDC or flammable gas.

Figure 1B:
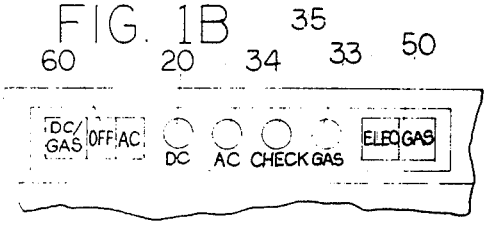
FIG. 1B is an enlarged fragmentary view of the visual display of an alternate embodiment of the absorption refrigerator of the present invention.

As illustrated in FIG. 1B, this embodiment uses one rocker switch 50 to select ELEC or GAS, and a second rocker switch 60 to select DC/GAS or AC. In addition, the ELEC lamp 34 illustrated in connection with the previous embodiment now indicates the selection of AC voltage, while a new DC lamp 70 is used to indicate that the direct current mode of operation has been selected.

Lamp or indicator 70 is preferably of a different color, for example yellow, than any of the other indicators. It will be observed that the four indicator lamps are arranged side-by-side in a horizontal row above the freezer compartment for high visibility.

Referring to FIG. 5, when mode switch 60 is in the AC position, AC lamp 34 will be illuminated, and AC heater 25 will be energized if thermostat 36 is calling for cooling as previously described. This operation will occur regardless of the position of ELEC/GAS switch 50.

When mode switch 60 is in the DC position, the operational mode will depend upon the setting of ELEC/-GAS selector switch 50 as well. Assuming that mode switch 50 has been moved to the ELEC position, 12 VDC will be applied to DC lamp 70 through switch pole 50*a*, and to resistor R1 and one terminal of thermostat 36 through switch pole 60*a*. This action causes transistors Q1 and Q2 to turn on, thereby illuminating DC lamp 70 in a manner similar to that previously described. When thermostat 36 calls for cooling, the thermostat switch closes placing 12 VDC on switch poles 50*b* and 60*b*. This causes relay coil 80 to be energized, thereby closing relay contacts 81 and energizing DC heater 82. Heater 82 then supplies heat to generator 24 as previously described. When thermostat 36 opens, relay coil 80 is de-energized, thereby opening relay contacts 81 and de-energizing heater 82. It will be observed that this mode of operation only occurs if switch 50 is in the ELEC mode and switch 60 is in the DC mode of operation.

If switch 50 is shifted to the GAS mode of operation, and switch 60 is in the DC mode of operation, heat is supplied to generator 24 by gas burner 17 in a manner similar to that previously described. That is, 12 VDC is applied to GAS lamp 33 through switch pole 50*a*, and to resistor R1 and one terminal of thermostat 36 through switch pole 60*a*. This causes transistors Q1 and Q2 to turn on, thereby illuminating GAS lamp 33. If thermostat 36 is calling for cooling, the thermostat switch closes, placing 12 VDC on switch contacts 50*b* and 60*b*, thereby applying direct current to the POWER input of second control module 11. This module operates as previously described to ignite and monitor the burner flame. It will be observed that the GAS mode of operation will occur only if the ELEC/GAS switch 50 is in the GAS mode, and switch 60 is in the DC mode. As in the previous embodiment, failure of the gas burner to ignite after some period of time, e.g. 10 seconds, resulting in a lock-out condition will be indicated by illumination of the CHECK lamp 35.

It will be observed that the present invention also eliminates the need for a standing pilot light to ignite the main burner, which in conventional refrigerator designs is susceptible to blow-outs. As is well-know, if the pilot light failed, it would generally go unnoticed until the refrigerator became warm inside. Furthermore, the present invention eliminates the usual lighting operation which generally required both hands and took at least 30 seconds to carry out. By using electronic controls, the user operated components associated with the refrigerator of the present invention are located at the top of the refrigerator at eye level and within easy reach. As noted, the automatic spark ignition also eliminates the need for any type of flame viewing device. Finally, the electronic controls permit the refrigerator to be operated on gas or electricity by positioning a small rocker switch which can be easily and quickly operated by an inexperienced user.

It will be understood that various changes may be made in the details, steps, materials and arrangements of parts within the principle and scope of the present invention as expressed in the appended claims.

The embodiments of the invention in which an exclusive property or privilege is claimed are as follows:

1. In a gas operated absorption refrigeration apparatus of the type having a heat operated generator and a flammable gas burner for supplying heat to the generator, the improvement in combination therewith comprising means for monitoring the presence or absence of the burner flame and visually perceptible electrically operated lamp means responsive to said monitor means for providing an indication of the absence of flame at the burner when the refrigeration apparatus is calling for cooling, said refrigeration apparatus comprising a box-like enclosure defining an upper freezer compartment and a lower cold food compartment, each of said compartments having a vertically mounted hinged outwardly opening door, said lamp means being mounted on said enclosure above said freezer compartment door so as to be visible from the front of the refrigerator enclosure and comprising a first indicator for providing a visible indication when said heater is selected, a second indicator for providing a visible indication when said burner is selected, and a third indicator for providing a visible indication of the absence of said flame at the burner when said burner is selected, each of said indicators being of a different color, and an electrically operable resistance heater for supplying heat to said generator, and means for selecting said heater or said burner.

2. The apparatus according to claim 1 wherein said indicators are arranged side-by-side in a horizontal row.

3. The apparatus according to claim 1 including first and second electrically operable resistance heaters for supplying heat to said generator and means for selecting one of said heaters and burner, said lamp means comprising a first indicator for providing a visible indication when said first heater is selected, a second indicator for providing a visible indication when said second heater is selected, a third indicator for providing a visible indication when said burner is selected, and a fourth indicator for providing a visible indication of the absence of said flame at the burner when said burner is selected, each of said indicators being of a different color.

4. The apparatus according to claim 3 including means responsive to said selecting means for operating said first heater from a source of alternating current and means responsive to said selecting means for operating said second heater from a source of direct current.

5. The apparatus according to claim 4 wherein said indicators are arranged side-by-side in a horizontal row.

6. A refrigerator of the type having a box-like enclosure cooled by absorption refrigeration apparatus including a heat operated generator, said refrigerator comprising thermostat means for monitoring the internal temperature of the refrigerator enclosure, electrically operated resistance heater means for supplying heat to the generator, a gas burner for providing heat to the generator, electrically operated valve means for controlling the supply of gas to the burner, electrically operated ignition means for establishing a flame at the gas burner, means for monitoring the presence or absence of the flame at the burner, and control means for controlling the operation of said burner and heater means comprising switch means for selecting said burner or said heater means so that the refrigeration apparatus is selectively operated by gas or electricity, starting means for operating said valve means and said ignition means for a short period of time to establish said flame if said thermostat means is calling for cooling, restart means responsive to said monitoring means to re-establish said flame by activating said ignition means if the flame is interrupted while said thermostat means is calling for cooling, and lock-out means for preventing further operation of said valve means and said ignition means if the flame is not established at said burner within a first predetermined time following initial activation of said valve and ignition means by said starting means or if the flame is interrupted and not re-established within a second predetermined time following activation of said ignition means by said restart means.

7. The refrigerator according to claim 6 including first and second electrically operated resistance heaters for supplying heat to the generator, said switch means including means for selecting one of said heaters and burner, and means responsive to said switch means for operating said first heater from a source of alternating current and said second heater from a source of direct current.

8. The refrigerator according to claim 6 wherein said monitoring means and ignition means comprise a pair of spaced elongated electrically conducting rod-like electrodes positioned above said burner such that the ends of the electrodes extend into the burner flame.

9. The refrigerator according to claim 6 including indicator means responsive to said lock-out means for providing a visual indication when said lock-out means prevents operation of said valve and ignition means.

10. The refrigerator according to claim 9 wherein said refrigerator enclosure defines an upper freezer compartment and a lower cold food compartment, each of said compartments having a vertically mounted hinged outwardly opening door, said indicator means being mounted on said enclosure above said freezer compartment door so as to be visible from the front of the refrigerator enclosure.

11. The refrigerator according to claim 9 including a first indicator for providing a visible indication when said heater is selected, a second indicator for providing a visible indication when said burner is selected, and wherein said indicator means comprises a third indicator for providing a visible indication of the absence of said flame at the burner when said burner is selected, each of said indicators being of a different color and arranged side-by-side in a horizontal row.

12. A gas/electric refrigerator having a vertically oriented box-like enclosure defining an upper freezer compartment and a lower cold food compartment, each of said compartments having a vertically mounted hinged outwardly opening door, said compartments being cooled by absorption refrigeration apparatus including a heat operated generator, a thermostat located within said cold food compartment for monitoring the internal temperature of the refrigerator enclosure, an electrically operated resistance heater for supplying heat to the generator, a gas burner for providing heat to the generator, an electrically operated valve for controlling the supply of gas to the burner, electrically operated ignition means for establishing a flame at the gas burner, said ignition means comprising an elongated electrically conducting rod-like electrode positioned above said burner such that the end of the electrode extends into the burner flame, means for monitoring the presence or absence of the flame at the burner comprising an elongated electrically conducting rod-like electrode spaced from said ignition electrode and positioned above said burner such that the end of the monitor electrode extends into the burner flame, control means for controlling the operation of said burner and heater comprising manually operable switch means for selecting either of said burner or said heater so that the refrigeration apparatus is operated by gas or electricity, starting means for operating said valve and for producing a high voltage electrical spark at said ignition electrode for a short period of time to establish the flame if the thermostat is calling for cooling, restart means responsive to said monitoring electrode to re-establish the flame by producing a high voltage spark at said ignition electrode if the flame is interrupted while the thermostat is calling for cooling, lock-out means for preventing further operation of said valve and ignition electrode if the flame is not established at the burner within a predetermined time period following initial actuation of said valve and ignition electrode by said starting means or if the flame is interrupted and not re-established within said predetermined time period following activation of said ignition electrode by said restart means, and visually perceptible electrically operated lamp means responsive to said monitor electrode for providing an indication of the absence of flame at the burner when the thermostat is calling for cooling, said lamp means being mounted on said enclosure above said freezer compartment door so as to be visible from the front of the refrigerator enclosure and comprising a first indicator for providing a visible indication when said heater is selected, a second indicator for providing a visible indication when said burner is selected, and a third indicator, responsive to said lock-out means, for providing a visible indication of the absence of said flame at the burner when said burner is selected, each of said indicators being of a different color and arranged side-by-side in a horizontal row.

13. The refrigerator according to claim 12 including first and second electrically operated resistance heaters for supplying heat to the generator, said switch means including means for selecting one of said heaters and burner, means responsive to said switch means for operating said first heater from a source of alternating current and said second heater from a source of direct current, said first indicator providing a visible indication when said first heater is selected, and a fourth indicator for providing a visible indication when said second heater is selected, all of said indicators being of different colors and arranged side-by-side in a horizontal row on said enclosure above said freezer compartment.

14. The refrigerator according to claim 13 wherein one of said indicators is blue, one of said indicators is green, one of said indicators is yellow, and one of said indicators is red.

* * * * *